US009783915B2

(12) United States Patent
Cooper

(10) Patent No.: US 9,783,915 B2
(45) Date of Patent: Oct. 10, 2017

(54) LAPPING MACHINE DRIVE

(71) Applicant: V-Lap Pty. Ltd., Cheltenham (AU)

(72) Inventor: Jason Ian Cooper, Cheltenham (AU)

(73) Assignee: V-Lap Pty. Ltd., Cheltenham (AU)

( * ) Notice: Subject to any disclaimer, the term of this patent is extended or adjusted under 35 U.S.C. 154(b) by 355 days.

(21) Appl. No.: 14/418,946

(22) PCT Filed: Oct. 30, 2014

(86) PCT No.: PCT/AU2014/001016

§ 371 (c)(1),
(2) Date: Feb. 1, 2015

(87) PCT Pub. No.: WO2015/176099

PCT Pub. Date: Nov. 26, 2015

(65) Prior Publication Data

US 2016/0244895 A1 Aug. 25, 2016

(30) Foreign Application Priority Data

May 21, 2014 (AU) ..... 2014901887

(51) Int. Cl.
*D01G 25/00* (2006.01)
*D04H 1/74* (2006.01)
*D04H 11/04* (2006.01)

(52) U.S. Cl.
CPC ..... *D01G 25/00* (2013.01); *D04H 1/74* (2013.01); *D04H 11/04* (2013.01)

(58) Field of Classification Search
CPC ..... D01G 25/00; D04H 11/04
See application file for complete search history.

(56) References Cited

U.S. PATENT DOCUMENTS 3,939,030 A * 2/1976 Wethington ..... D04H 11/04 156/435
3,941,645 A * 3/1976 Wethington ..... D04H 11/04 156/435
3,943,027 A * 3/1976 Wethington ..... D04H 11/04 156/178
3,976,531 A * 8/1976 Dillinger ..... D04H 11/04 156/361
4,363,694 A 12/1982 Fay
(Continued)

FOREIGN PATENT DOCUMENTS

CN 201817681 5/2011
EP 0405940 1/1991

*Primary Examiner* — Shaun R Hurley
(74) *Attorney, Agent, or Firm* — Chernoff Vilhauer LLP

(57) ABSTRACT

A high speed vertical textile lapper has a comb reciprocated by a first motor and a presser bar reciprocated by a second motor, both motors being under a common servo motor control. The linear comb is reciprocated by a comb crankshaft in a crankcase while the presser bar is reciprocated by a bar crankshaft in order to deposit a lapped web onto a horizontal conveyor which sends the web through an oven where some of the web fibers fuse to adhere the finished web. The incoming web to be plated is carried to the lapping zone by a combination of horizontal and vertical conveyors. These feed the descending web close to the lapping zone. The comb crankcase has pressurized lubrication and external cooling. The servo control permits PLC synchronization.

21 Claims, 4 Drawing Sheets

(56) References Cited

U.S. PATENT DOCUMENTS

| | | | | |
|---|---|---|---|---|
| 5,080,267 | A * | 1/1992 | Yogo | D04H 1/70 112/132 |
| 5,110,397 | A * | 5/1992 | Fraser | D04H 11/04 156/435 |
| 5,558,924 | A | 9/1996 | Chien et al. | |
| 5,955,174 | A | 9/1999 | Wadsworth et al. | |
| 7,591,049 | B2 * | 9/2009 | Cooper | B65H 45/107 19/163 |
| 2008/0155787 | A1 * | 7/2008 | Cooper | B65H 45/107 19/163 |

* cited by examiner

LAPPING MACHINE DRIVE

CROSS-REFERENCE TO RELATED APPLICATIONS

This is the U.S. National Stage of International Application No. PCT/AU2014/001016, filed Oct. 30, 2014, which in turn claims the benefit of Australia Patent Application No. AU 2014901887, filed May 21, 2014.

TECHNICAL FIELD

This invention concerns textile lapping machines which make pleated fibrous webs.

This drive unit is for a lapping machine into which is fed a fibrous web made by subjecting raw fibrous starting material to an opener and a blender then passing the product to a cross lapper and a finish card. The pleated web up to 3 m wide is passed immediately after pleating into an oven on a continuous conveyor where the fibres in the web bond to a greater or lesser extent depending on dwell time, temperature and the type of fibre.

Our Australian Patent No. 2006200908 describes such a lapping machine.

BACKGROUND

Some machines produce non-woven continuous mat-like ribbons direct from a carding machine in widths from 500-3000 mm.

Our Australian Patent No. 2006200908 referred to above describes such a machine. This builds a pleated web about 3000 mm wide which is fed into an oven where the fibres introduced during the lapping process become adhesive and bond to the surrounding fibres.

The oven treatment creates a springy, stable ribbon product capable of being wound into rolls or cut into sheets of 50-2500 gsm.

The horizontal comb which pleats the advancing web is fixed to the ends of a row of rods which rise and fall in response to individual reciprocators, each belt driven from a common drive motor. The rod spacing is about 500 mm.

The depth of the pleats is changed by adjusting the height of the lapping zone in which the pleated web advances on its travel through the zone to the oven.

Raising the roof of the zone allows the pleats to be either shallow or deep. The conveyor on which the fibrous web is pushed by the comb advances toward the oven at constant speed. A screw control raises and lowers the roof of the zone so the change from one product specification to another is convenient and rapid.

Increasing the throughput speed presents difficulties in that greater forces act on the comb whereas the drive to the presser bar which inserts needles and filaments into the web must remain synchronised in order to preserve the build of the mat-like product.

SUMMARY OF INVENTION

The apparatus aspect of the invention provides a lapping device for lapping a textile web from a card so as to form a pleated sheet of fabric comprising a comb reciprocable by a first motor, a presser bar reciprocable by a second motor, wherein the comb drive further comprises a crankcase containing a comb crankshaft with multiple cranks, a servo motor to drive the crankshaft, a linear comb spaced from the comb crankshaft, a connector assembly extending from each crank to the comb, whereby the assemblies act in unison to reciprocate the comb and a presser bar drive further comprises a crankcase containing a bar crankshaft with multiple cranks, a servo motor to drive the bar crankshaft, a presser bar spaced from the bar crankshaft, a connector assembly extending from each crank to the presser bar, whereby the assemblies act in unison to reciprocate the presser bar.

The crankshaft may operate in a crankcase to which the motor is attached. The case may have a pair of bearings for each crank and a mount for each connector assembly disposed at 90 degrees to the axis of the crankshaft.

Each assembly may have a connecting rod extending from the crank and a comb link pivoted to the free end of the connecting rod at one end of the link and connectable to the comb at the opposite end.

The connecting rod and pivot may project into a compartment which contains lubricant.

The link may reciprocate in a guide projecting from the crankcase. The guide may include a lubricant seal.

The crankcase may contain part of a cooling circuit arranged to cool each of the compartments. The remaining part of the circuit may be outside the crankcase.

The presser bar may be reciprocated by a motor which is under the same servo motor control which controls the comb-reciprocating servo motor. This permits the individual drives to the comb and the presser bar to stay synchronised.

The crankcase for the comb drive and the crankcase for the presser bar drive may be modules in order to handle specific widths of web. The web may be divided lengthwise to give one wide and one narrow batt.

Advantageous Effects of Invention

1. Increased throughput.
2. Adjustment of timing through programmable logic control (PLC) servo adjustment between master and slave in degrees, replacing any manual timing belt adjustment.
3. Separation and re-connection of master and slave through PLC when adjustment is required.

BRIEF DESCRIPTION OF DRAWINGS

Certain embodiments of the invention are now described with reference to the accompanying drawings, in which.

DESCRIPTION OF EMBODIMENTS

The apparatus is designed to make a continuous fabric web up to 75 mm thick at speeds up to 100 m/min.

Figure 1:
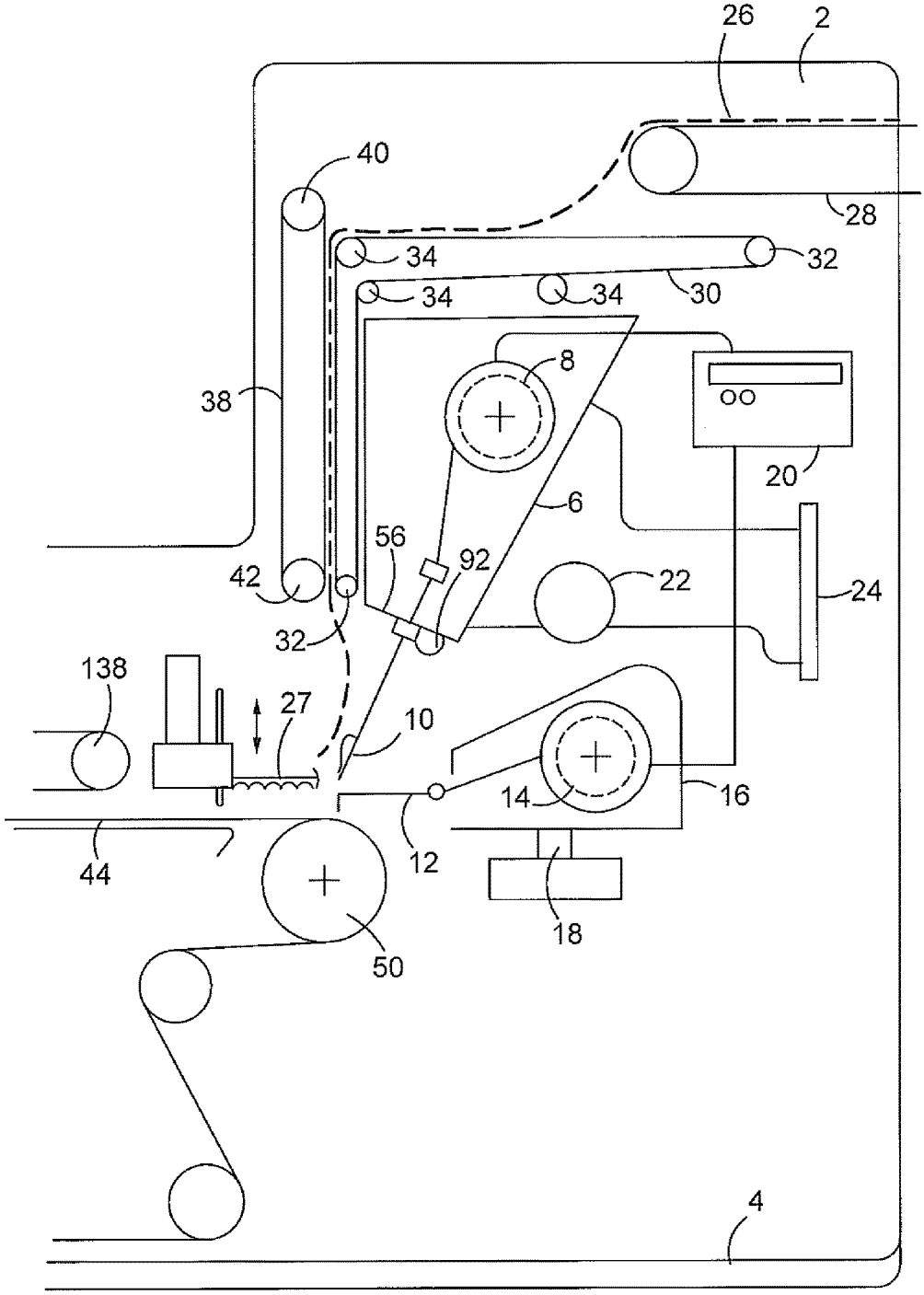
FIG. 1 is a diagrammatic view of the synchronised drives to the comb and presser bar of a lapping machine.

Referring firstly to FIG. 1, vertical walls 2 are made of steel plate joined by floor 4. Lapping machine crankcase 6 is supported horizontally between the walls 2 and motor 8 reciprocates comb 10 at waist height. Presser bar 12 with its motor 14 are housed in box 16 which is fixed to moveable mount 18 supported between walls 2. Both motors 8 and 14 are controlled and synchronised by motor control box 20 which affords programmable logic function. Oil pump 22 takes oil from crankcase 6 and sends it through oil cooler 24.

Web 26 from a card (not shown) reaches the vertical lapper by duffer 28 which deposits the web on the L-shaped conveyor belt 30 which consists of two driver rolls 32 and three idler rolls 34. The lowermost roll 32 is a few centimeters away from comb 10. If the web 26 contains brittle fibres, for example glass fibre, the descent to the comb imposes sagging and this may tear the web. This possibility is removed by a second conveyor 38 running between rolls 40, 42 which match the feed speed of the L-shaped conveyor. The second conveyor is perforated in order to be air pervious.

Rolls 40, 42 are adjustable toward and away from the vertical portion of conveyor 30 in order to vary the planar nip through which web 26 is conveyed. The web leaves the nip and descends 170 mm to the surface of horizontal conveyor 44. The end of the comb path is coincident with the circumference of roll 50 which drives conveyor 44 through oven 52 shown in FIG. 5. Horizontal conveyor 44 is perforated to conduct hot air through web 26. Shark plate assembly 27 defines the passage through which the pleated web enters oven 52 and is adjustable for height.

Figure 2:
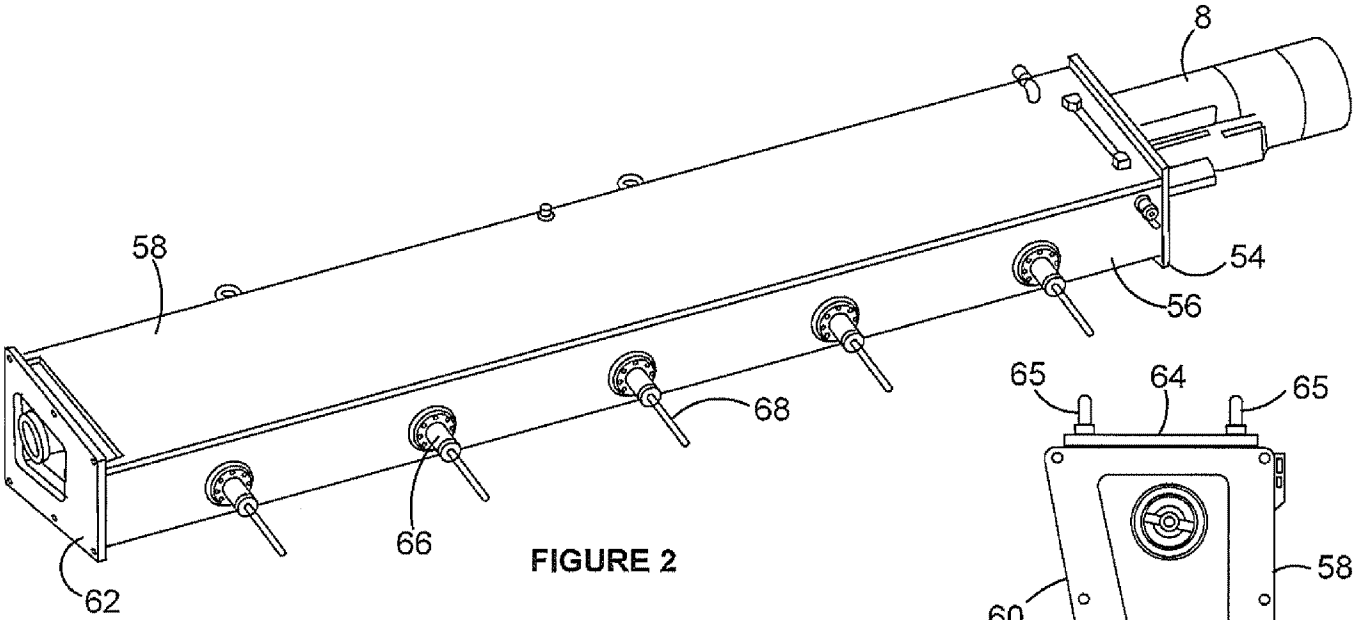
FIG. 2 is an underneath perspective of the motor and crankcase.

Referring now to FIG. 2, servo motor 8 is fixed to end plate 54 of crankcase 6 and projects through an aperture in side wall 2. Crankcase 6 has a base 56, converging side walls 58, 60, opposite end plate 62 and cover 64. The end plates attach to side walls 2. Eyes 65 extending from cover 64 allow the crankcase to be removed for servicing.

Base 56 has five apertures which allow rod guides 66 to extend into the crankcase interior. Link rods 68 each have a terminal flat which allows this to receive and clamp carbon fibre composite comb 10.

Figure 3:
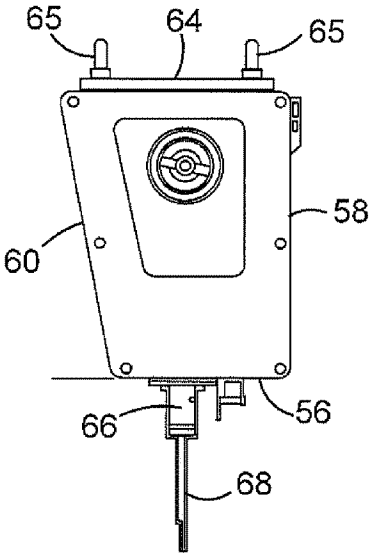
FIG. 3 is an end view of FIG. 2.
Figure 4:
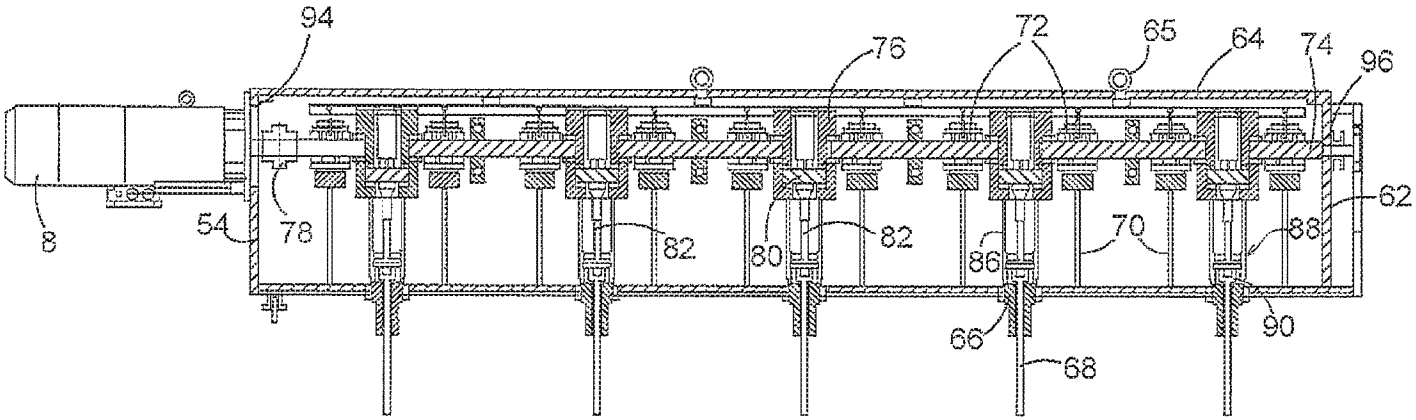
FIG. 4 is a sectional side view of FIG. 2.

Referring now to FIGS. 3 and 4, the crankcase is divided longitudinally into compartments by ten mutually parallel cross walls 70 which stiffen the crankcase. Cutouts at base level allow the compartments to act as a unitary sump. Each wall has a seat for a 50 mm spherical bearing 72. A 50 mm dia crankshaft 74 with five cranks 76 each supported by a pair of spherical bearings extends between the end plates 54, 62 and one end is connected to the output shaft of servo motor 8 by coupling 78. The throw of each crank is 150 mm and the cranks all reach top dead centre at the same time.

Presser bar 12 is likewise reciprocated by a similar crankshaft, five bearings and five links.

These guides attach to the base 56 of the crankcase and open into a row of cylindrical sleeves 86. Each sleeve 86 contains a piston with TEFLON® seals. The pistons each have a gudgeon 88 which connects the piston to the connecting rod 82 and a lower pin 90 connects the piston to the top of link rod 68. Slots (not shown) in the upper ends of the sleeves allow passage of the connecting rods. Each cylinder 86 and each spherical bearing 72 receives oil from the pump 22. Oil drains into the guides 866 and returns to the oil pump through pipes 92.

Speeds up to 1800 rpm are attainable. The comb drive crankcase 6 has a sealing ring 94 and a shaft seal 96.

Figure 5:
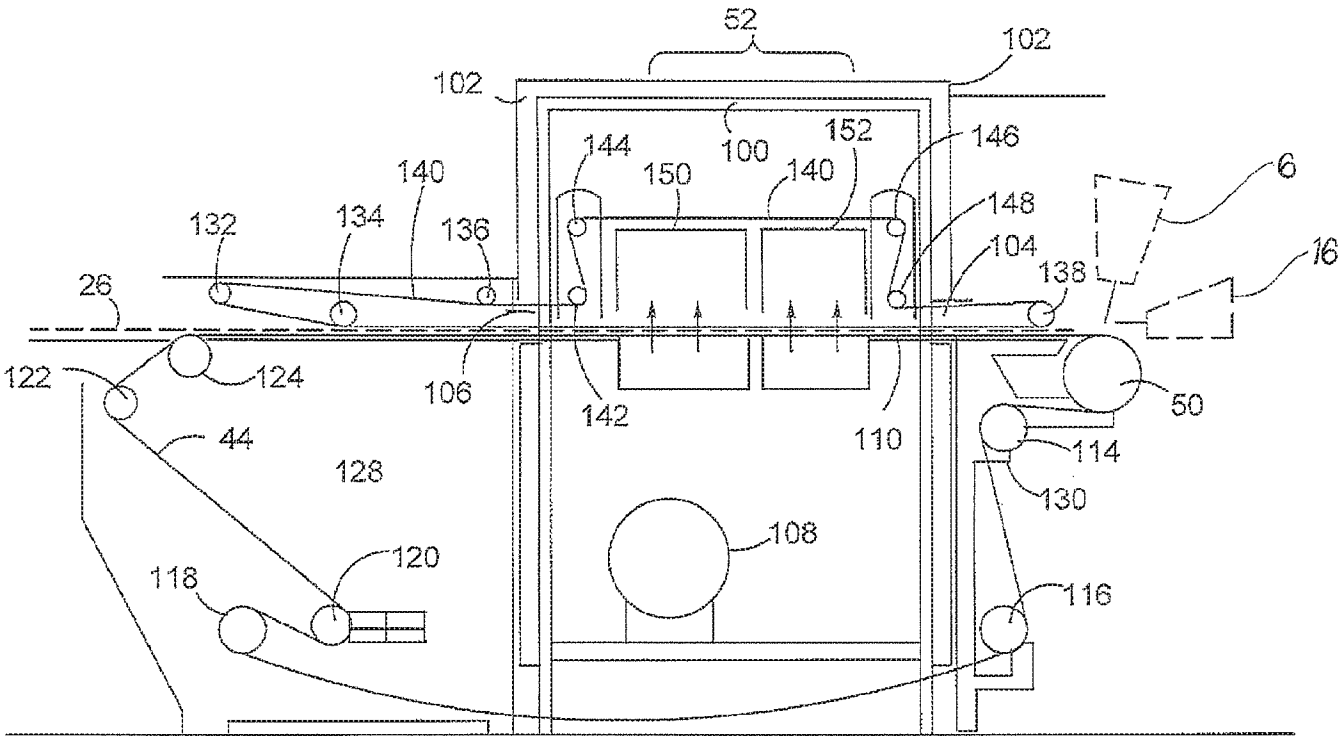
FIG. 5 is a sectional view of the oven.

Referring now to FIG. 5, oven frame 100 supports insulated side walls 102 with an inlet 104 adjacent the output of the vertical lapper and an outlet 106 from which the heat treated fabric emerges. Fan duct 108 circulates gas-heated air at a temperature of 120-220 degrees Celsius depending on the type of fabric. Metal shelf 110 supports the entering portion of lower conveyor belt 44 through the oven and the rollers 50, 114, 116, 118, 120, 122 and 124 are supported on external steel walls 128, 130.

These walls also support external rollers 132, 134, 136 and 138, the purpose of which is to support upper conveyor belt 140 thereby creating a continuous contact path for the lapped web 26 while it is heated in order to render the fibres adhesive. Internal rollers 142, 144, 146 and 148 guide the upper belt conveyor around twin ducts 150, 152. Twin ducts 150 and 152 each have a lower static section and an upper rise and fall section. Both lower sections direct pressurised hot air through the perforated lower conveyor through the full thickness of the web into the upper section from which it is recirculated. The upper sections are height adjustable to take different thicknesses of web.

In another embodiment not illustrated, compartments are each cooled by a metal box which lies between one side of the compartment and the adjacent cross wall 70. The box surface is insulated thermally on all faces except the one contacting the compartment. The box contains a cooling coil and the boxes are connected to a common cooling circuit, the refrigerant pump being outside the crankcase. In practice the lubricant temperature is thereby kept within a suitable range.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

The invention claimed is:

1. A lapping device for lapping a textile web from a card so as to form a pleated sheet of fabric comprising comb assembly and a presser bar assembly, the comb assembly comprising:

a comb reciprocatable by a comb drive, the comb drive being in the form of a first motor;

a crankcase containing a comb crankshaft with multiple comb cranks; and a connector assembly extending from the comb crank to the comb, the presser bar assembly comprising:

a presser bar reciprocatable by a presser bar drive in the form of a second motor;

a bar crankcase containing a bar crankshaft with multiple bar cranks;

a presser bar spaced from the bar crankshaft; and a bar connector assembly extending from each bar crank to the presser bar, whereby the comb assembly and the presser bar assembly act in unison to reciprocate the comb drive and the presser bar drive.

2. A lapping device as claimed in claim 1, wherein the comb crankcase has transverse walls for supporting bearings for each comb crank and each comb crank drives a connector assembly which reciprocates the comb.

3. A lapping device as claimed in claim 2, wherein each connector assembly has a connecting rod extending from the crank and a comb link pivoted to the free end of the connecting rod at one end of the link and connected to the comb at the opposite end.

4. A lapping device as claimed in claim 3, wherein the comb link reciprocates in a guide projecting from the comb crankcase.

5. A lapping device as claimed in claim 4, wherein the guide is a passage which contains a lubricant seal.

6. A lapping device as claimed in claim 2, wherein the bearings for each comb crank comprises a pair of bearings and the comb crankcase acts as a lubrication sump and a pump delivers lubricant to the pairs of bearings, the pivot between the connecting rod and the comb crank and the passage containing the comb link.

7. A lapping device as claimed in claim 6, wherein the pump is outside the comb crankcase and is part of an oil cooling circuit.

8. A lapping device as claimed in claim 1, wherein the comb crankcase has a shaft seal for the end of the comb crankshaft opposite the first motor.

9. A lapping device as claimed in claim 1, wherein the comb crankcase is constructed as a module in order to permit joining to serve combs of different lengths.

10. A lapping device as claimed in claim 1, wherein the comb is made of steel, aluminium, aluminium alloy or a carbon fibre composite.

11. A lapping device as claimed in claim 1, wherein the comb is a linear comb spaced from the comb crankshaft and the comb stroke is 150 mm.

12. A lapping device as claimed in claim 1, wherein the crank speed is 100-2000 rpm.

13. A lapping device as claimed in claim 1, wherein the presser bar is reciprocated by the second motor which is under a joint servo motor control as the first motor.

14. A lapping device as claimed in claim 13, wherein the joint servo motor control offers programmable logic control (PLC) synchronisation.

15. A lapping device as claimed in claim 1 in combination with a web feed apparatus arranged to allow the fed web to descend toward the comb.

16. The combination of claim 15, wherein the web feed apparatus comprises a pair of belt-feed devices, including first and second belt feed devices, alongside the comb crankcase arranged face to face in order to release the web from a planar slot between faces of the belt-feed devices into a space adjacent the comb.

17. The combination of claim 16, wherein the first belt feed device has an L-shaped path with a covered area and an uncovered area, the covered area being covered by the second shorter straight belt feed device disposed parallel to the first and defining the planar slot which terminates at the space adjacent the comb.

18. The combination of claim 16, wherein an exit conveyor from a card deposits web onto the first belt feed device.

19. The combination of claim 17, wherein a belt of the second belt feed device is perforated to allow air flow.

20. A lapping device as claimed in claim 1 in combination with an oven for softening fibres in the textile web to render them adherent.

21. The combination of claim 20, wherein the textile web travels through the oven between a pair of belt feed conveyors.

* * * * *